US007100390B2

(12) United States Patent
Hebestreit et al.

(10) Patent No.: US 7,100,390 B2
(45) Date of Patent: Sep. 5, 2006

(54) CONDENSER-EVAPORATOR SHELL CONFIGURATION FOR A REFRIGERATING DEVICE

(75) Inventors: Lutz Hebestreit, Syrgenstein (DE); Alfred Lang, Syrgenstein (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 0 days.

(21) Appl. No.: 11/023,071

(22) Filed: Dec. 27, 2004

(65) Prior Publication Data

US 2005/0144967 A1 Jul. 7, 2005

Related U.S. Application Data

(63) Continuation of application No. PCT/EP03/06691, filed on Jun. 25, 2003.

(30) Foreign Application Priority Data

Jun. 25, 2002 (DE) ..... 202 09 839 U

(51) Int. Cl.
*F25D 21/14* (2006.01)

(52) U.S. Cl. ..... 62/279; 62/289; 62/513

(58) Field of Classification Search ..... 62/288, 62/289, 291, 279, 513
See application file for complete search history.

(56) References Cited

U.S. PATENT DOCUMENTS

| | | | | |
|---|---|---|---|---|
| 2,909,907 | A * | 10/1959 | Swanson | 62/155 |
| 5,590,541 | A | 1/1997 | Rainwater | |
| 5,699,677 | A * | 12/1997 | Hakala et al. | 62/291 |
| 5,881,566 | A * | 3/1999 | Shacklock et al. | 62/277 |

FOREIGN PATENT DOCUMENTS

| | | |
|---|---|---|
| DE | 199 62 256 A1 | 6/2001 |
| FR | 1.595.334 | 7/1970 |
| FR | 2 237 531 | 2/1975 |

* cited by examiner

*Primary Examiner*—Harry B. Tanner
(74) *Attorney, Agent, or Firm*—John T. Winburn; Russell W. Warnock; Craig J. Loest

(57) ABSTRACT

An evaporator shell is mounted on the half-shell of a condenser housing. The evaporator shell is retained with the aid of retaining claws that engage from the rear with catching flanks formed on the upper half-shell.

10 Claims, 2 Drawing Sheets

CONDENSER-EVAPORATOR SHELL CONFIGURATION FOR A REFRIGERATING DEVICE

CROSS-REFERENCE TO RELATED APPLICATION

This is a continuing application, under 35 U.S.C. § 120, of copending international application No. PCT/EP2003/006691, filed Jun. 25, 2003, which designated the United States; this application also claims the priority, under 35 U.S.C. § 119, of German patent application No. 202 09 839.7, filed Jun. 25, 2002; the prior applications are herewith incorporated by reference in their entirety.

BACKGROUND OF THE INVENTION

Field of the Invention

The present invention relates to a configuration with a condenser and an evaporator shell for a refrigerating device, such as for instance a refrigerator or freezer cabinet.

In the case of a refrigerator, moisture given off by the refrigerated items to the air in the interior space of the refrigerator or moisture introduced by opening the door condenses on the evaporator. This moisture must be removed from the interior space of the refrigerator. For this purpose, a collecting channel which collects the moisture flowing off from the evaporator is generally fitted to a wall of the interior space, underneath the evaporator. From the lowest point of the collecting channel, a duct through which the water can flow away from the interior space is led through the housing wall of the refrigerator. This duct opens out in a conventional way into an open shell in which the water can evaporate. The shell is arranged above the condenser of the refrigerator, in order to warm up the water with the waste heat of the condenser and in this way speed up its evaporation.

Such evaporator shells are also used in the case of freezers with automatic defrosting, so-called no-frost appliances, in which the evaporator is artificially heated up from time to time in order to thaw frost which has been deposited on it.

Such a shell must be fitted as close as possible to the condenser in order to achieve adequate heating that ensures that the shell does not run over during operation and allow water to flow onto the condenser. In order to achieve such a close proximity between the condenser and the evaporator shell that is also consistent from appliance to appliance in mass production, the shell is generally not mounted on housing parts of the refrigerating device but directly on the condenser.

A known possible way of mounting the shell is to make it engage in a latching manner on pipe connecting pieces of the condenser. However, this is unsatisfactory from the aspect of a firm and reliable attachment of the evaporator shell, since a maximum of two fastening points are available on the inlet line and outlet line of the condenser and the distance between the pipe connecting pieces and the evaporator shell can be great.

The technique used at present by the assignee, BSH Bosch und Siemens Hausgeräte GmbH of Munich, Germany, therefore uses flat pins which are welded onto the upper side of the condenser in order to mount the evaporator shell on it. With this technique, the evaporator shell can indeed be mounted firmly and securely and also with a reproducible position with respect to the condenser, but it has the disadvantage that the welding is labor-intensive, because the places on the condenser housing that are intended for attaching the pins have to be ground smooth in advance, and that the possibility of damage to the condenser housing caused by careless welding cannot be ruled out. If a hole is formed in the housing of the condenser during welding, this damage cannot be rectified cost-effectively, and the condenser has to be scrapped.

SUMMARY OF THE INVENTION

It is accordingly an object of the invention to provide a condenser/evaporator assembly, which overcomes the above-mentioned disadvantages of the heretofore-known devices and methods of this general type and which provides for a condenser-evaporator shell configuration that can be implemented in a simple and cost-effective manner.

With the foregoing and other objects in view there is provided, in accordance with the invention, a configuration for a refrigerating device, comprising:

a condenser for the refrigerating device, the condenser having a housing formed with an upper half-shell and a lower half-shell, the upper half-shell carrying latching flanks;

an evaporator shell mounted to the housing of the condenser, the evaporator shell bearing retaining claws configured to engage behind the latching flanks on the upper half-shell of the housing.

The latching flanks of the upper half of the shell can be already formed with little effort by machining during the production of the shell, before the condenser is assembled. The assembly of the configuration according to the invention can therefore take place in a simple way, in that the shell is simply pressed onto the condenser until it engages, or by placement and subsequent turning in the manner of a bayonet fastener.

To simplify the assembly, it is desirable that the upper half-shell has a basic shape which is rotationally symmetrical about an axis, and that the latching flanks are arranged at the same height with respect to this axis. In this way it is possible to mount the evaporator shell in many different orientations corresponding to the degree of symmetry; searching for an orientation of the shell that is suitable for mounting is made easier in this way, or made entirely superfluous.

In accordance with an added feature of the invention, the latching flanks are formed on at least one projection or at least one groove of the upper half-shell. This may be, in particular, a single, peripheral projection or a number of projections that are separate from one another and distributed at regular angular intervals around the periphery of the half-shell; in a corresponding way, the groove may also extend over the entire periphery of the half-shell, or a number of grooves extend in a plane over separate peripheral portions of the half-shell.

The retaining claws are preferably flexible, so that they are spread apart when the evaporator shell is fitted onto the upper half-shell, in order to be able subsequently to engage behind the latching flanks.

It may also be desirable to be able to use rigid retaining claws, such as for instance if the evaporator shell is formed from a rigid material and the retaining claws are intended to be in one part with the shell. In this case, latching engagement of the evaporator shell can be achieved in a simple way if the projections are separated in the peripheral direction of the upper half-shell by intermediate spaces, the width of which corresponds at least to the width of the retaining claws, so that the latter can be led through between the projections when the evaporator shell is placed onto the condenser, and can be made to engage on these during subsequent turning.

Other features which are considered as characteristic for the invention are set forth in the appended claims.

Although the invention is illustrated and described herein as embodied in a condenser-evaporator shell configuration for a refrigerating device, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
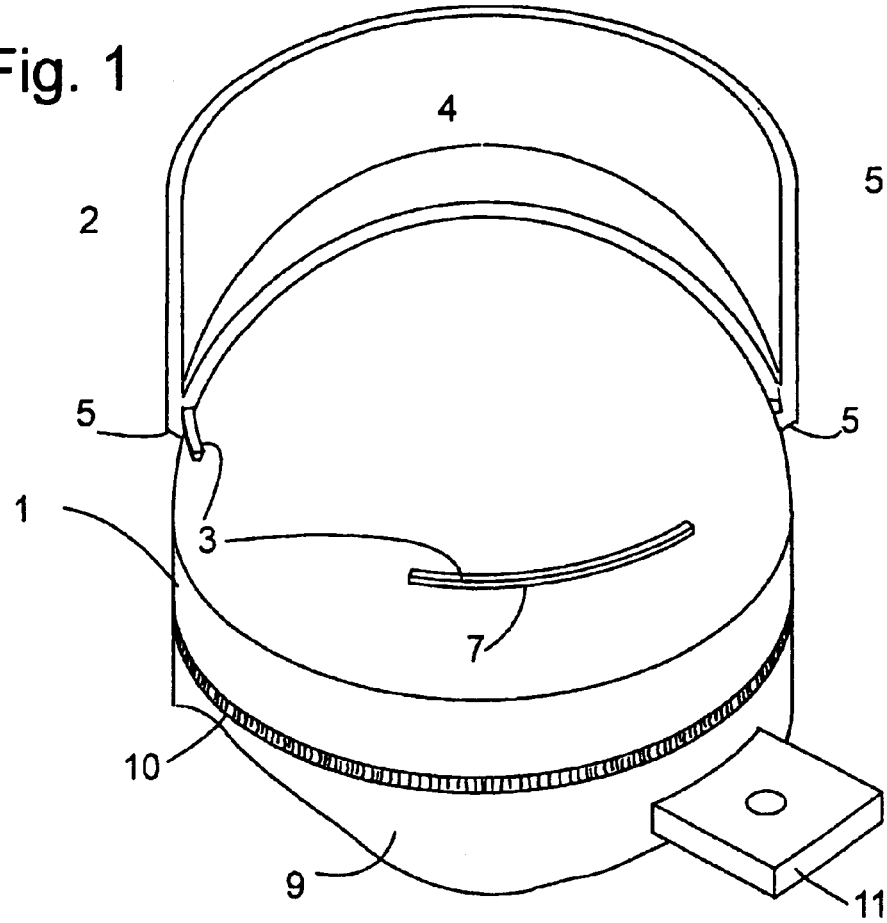
FIG. 1 shows a schematic, partly cut-away, perspective view of the upper part of a condenser with an evaporator shell mounted thereon.

Referring now to the figures of the drawing in detail and first, particularly, to FIG. 1 thereof, there is shown a perspective view of the upper part of the housing 1 of a condenser for a refrigerating device and, halved, an evaporator shell 2 mounted on it. An upper half-shell 1 and a lower half-shell 9, only represented in part, are connected by a weld seam 10. The lower half-shell 9 bears four fastening lugs 11 for screwing the condenser in a refrigerating device, only one of which can be seen in the figure. The half-shell 1 is a round dome, which is formed as one part from sheet metal by deep-drawing. Three rib-shaped projections 3 are formed out of the dome shape. These ribs 3 extend in each case about 60° in the same plane perpendicular to the vertical axis of symmetry of the dome.

Figure 2:
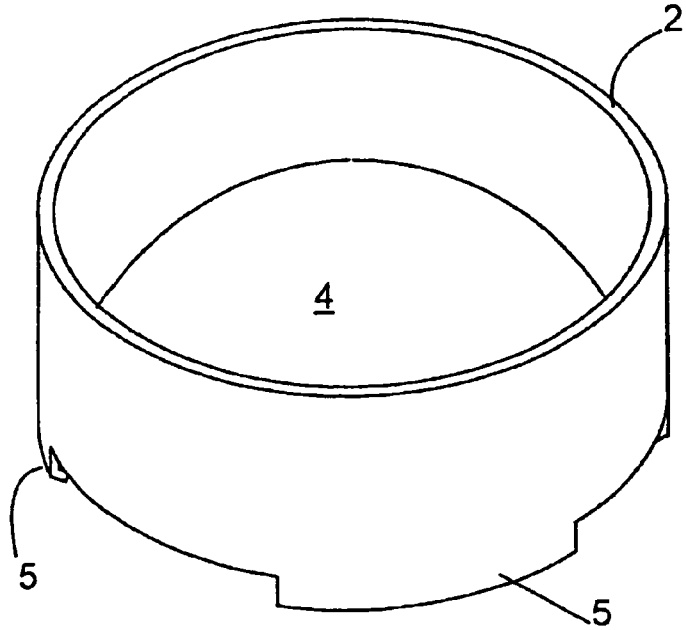
FIG. 2 is a perspective view of the complete evaporator shell from FIG. 1.

The evaporator shell 2 shown in its entirety in FIG. 2 has a base 4, which is adapted to the dome shape of the upper half-shell 1. Arranged at the edge of the base 4, where the latter meets the side wall of the evaporator shell 2, are three retaining claws 5. These likewise extend in each case over an angle of just 60° and are uniformly distributed over the periphery of the evaporator shell 2. In this way it is possible to mount the evaporator shell 2 by initially placing it onto the half-shell 1 in an orientation in which the retaining claws 5 reach through the intermediate spaces between adjacent ribs 3 and subsequently turning the evaporator shell 2, so that the retaining claws 5 come into contact with latching flanks 7 on the underside of the ribs 3 and in this way keep the evaporator shell 2 pressed against the upper half-shell 1.

The evaporator shell 2 according to this exemplary embodiment may be produced as one part from a rigid material, since the mounting does not require any significant deformation of the retaining claws 5.

In the case of an alternative configuration, the three ribs 3 are replaced by one rib extending over the entire periphery of the half-shell 1. In this case, the retaining claws of the evaporator shell must be flexible, in order that the evaporator shell can be mounted on the continuous rib by fitting it on, with the retaining claws being bent outward. For this purpose, the entire evaporator shell may be formed from a flexible material, or flexible retaining claws may be joined onto an otherwise rigid evaporator shell, for example formed on by injection-molding around it.

If the material of the retaining claws is not only flexible but also extensible, the retaining claws may also be formed as a closed ring, extending over the entire periphery of the evaporator shell 2.

Figure 3:
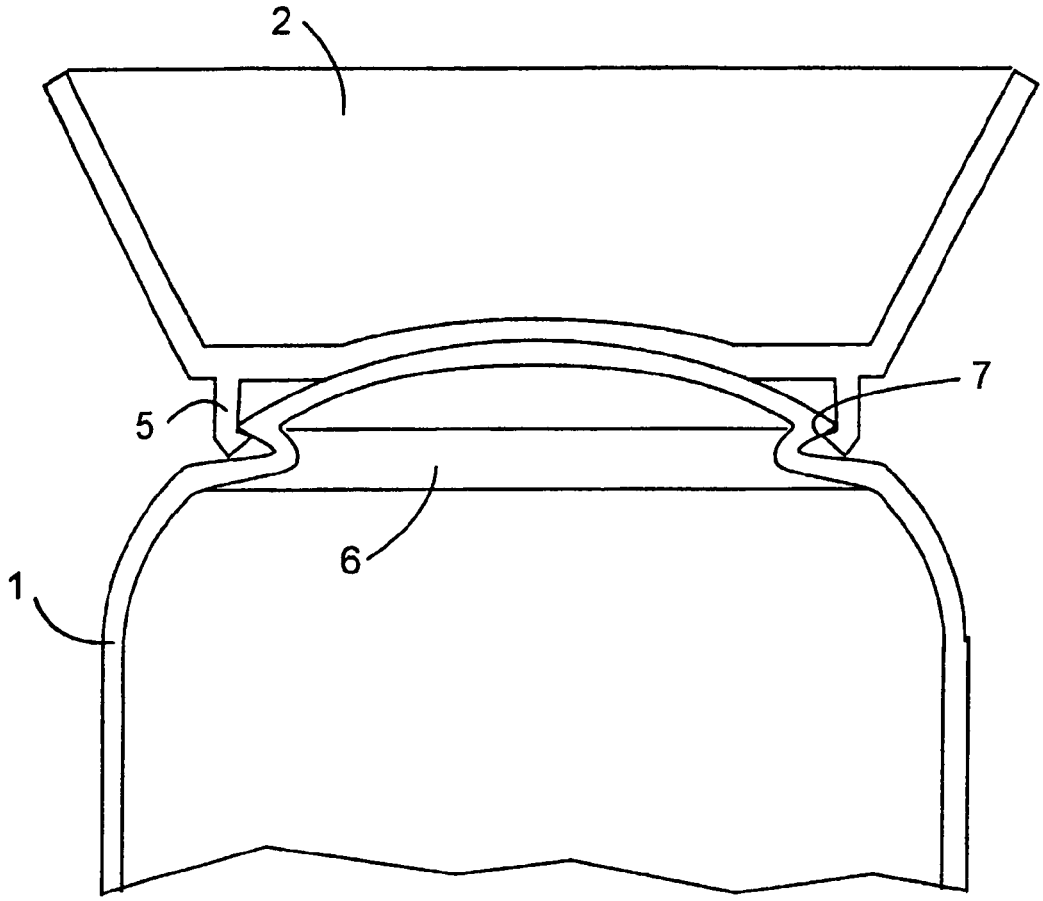
FIG. 3 is a section taken through the upper part of a condenser with an evaporator shell mounted on it according to a second configuration of the invention.

In the case of the second configuration of the configuration according to the invention, shown in section in FIG. 3, the evaporator shell is fastened to a peripheral groove 6, which is recessed in the upper half-shell 1. Here, too, the retaining claws 5 engaging in the groove 6 may also be distributed as a plurality over the periphery of the evaporator shell 2, or they may form a single closed ring.

Latching flanks 7 for anchoring the evaporator shell are formed here by the upper side wall of the groove 6.

We claim:

1. A configuration for a refrigerating device, comprising:

a compressor for the refrigerating device, said compressor having a housing formed with an upper half-shell and a lower half-shell, said upper half-shell carrying latching flanks, said latching flanks are formed on at least one groove, and said groove is recessed in said upper half-shell; and an evaporator shell mounted to said housing of said compressor, said evaporator shell bearing retaining claws configured to engage behind said latching flanks on said recessed groove in said upper half-shell of said compressor housing.

2. The configuration according to claim 1, wherein said upper half-shell has a basic shape with a rotational symmetry about an axis, and said latching flanks are disposed at a common height with respect to said axis.

3. The configuration according to claim 1, wherein said latching flanks are formed on at least one projection of said upper half-shell.

4. The configuration according to claim 1, wherein said retaining claws are flexible claws.

5. The configuration according to claim 3, wherein said at least one projection is one of a plurality of projections separated in a peripheral direction of said upper half-shell by intermediate spaces, and a width of said intermediate spaces corresponds at least to a width of said retaining claws.

6. The configuration according to claim 1, including said recessed groove in said upper half-shell formed substantially continuously around said evaporator shell.

7. The configuration according to claim 1, including said retaining claws are flexible claws formed substantially continuously around said upper half-shell.

8. A configuration for a refrigerating device, comprising:

a compressor for the refrigerating device, said compressor having a housing formed with an upper half-shell and a lower half-shell, said upper half-shell carrying latching flanks, said latching flanks are formed on at least one projection of said upper half-shell;

an evaporator shell mounted to said housing of said compressor, said evaporator shell bearing retaining claws configured to engage behind said latching flanks on said upper half-shell of said compressor housing; and said at least one projection is one of a plurality of projections separated in a peripheral direction of said upper half-shell by intermediate spaces, and the width of said intermediate spaces corresponds at least to a width of said retaining claws.

9. The configuration according to claim 8, wherein said retaining claws are flexible claws.

10. The configuration according to claim 8, wherein said upper half-shell has a basic shape with a rotational symmetry about an axis, and said latching flanks are disposed at a common height with respect to said axis.

* * * * *